United States Patent [19]

Tetrault

[11] Patent Number: 4,916,266

[45] Date of Patent: Apr. 10, 1990

[54] MINIATURE OMNIDIRECTIONAL INSTANTLY RESPONSIVE IMPACT SWITCH

[75] Inventor: Leonard P. Tetrault, Northport, N.Y.

[73] Assignee: Aerodyne Controls Corporation, Ronkonkoma, N.Y.

[21] Appl. No.: 363,280

[22] Filed: Jun. 8, 1989

[51] Int. Cl.[4] ..... H01H 35/14

[52] U.S. Cl. ..... 200/61.45 R; 200/61.51

[58] Field of Search ..... 200/61.45 R, 61.48–61.52, 200/220, 80 R, 61.48 R

[56] References Cited

U.S. PATENT DOCUMENTS

| | | | |
|---|---|---|---|
| 3,527,906 | 9/1970 | Schwab | 200/61.45 R X |
| 3,527,907 | 9/1970 | Schwab | 200/61.45 R X |
| 3,649,787 | 3/1972 | Kasabian | 200/61.45 R |
| 3,657,500 | 4/1972 | Gawlick | 200/61.45 R |
| 3,706,867 | 12/1972 | Rand et al. | 200/61.52 |
| 3,899,649 | 8/1975 | Jenkins | 200/61.51 |
| 4,746,774 | 5/1988 | Tetrault et al. | 200/61.45 R |
| 4,789,762 | 12/1988 | Miller et al. | 200/61.45 R |

*Primary Examiner*—J. R. Scott

*Attorney, Agent, or Firm*—Edward H. Loveman

[57] ABSTRACT

This miniature omnidirectional impact switch has a generally cylindrical electrically conductive mass held by coil spring bias in abutment with a conductive header wall at one end of a cylindrical housing. The mass has a blind bore in one end. The mass is held axially tilted by contact between a free end of a wire conductor and an end wall of the bore. A closed circuit is defined between a second conductor contacting the header wall and the first conductor, via the mass and header wall. The switch is responsive to an impact applied to the other end of the housing or to a side thereof within 200 microseconds after impact to open the closed circuit by separating the mass from the header wall and the end of the first conductor against the spring bias. A movement of the mass of 0.001 of an inch is sufficient to open the closed circuit.

10 Claims, 2 Drawing Sheets

MINIATURE OMNIDIRECTIONAL INSTANTLY RESPONSIVE IMPACT SWITCH

BACKGROUND OF THE INVENTION

1. Field of the Invention

This invention relates to the art of electrical acceleration switches of the type having a mass movable in a housing against a spring bias in response to an applied force, and more particularly concerns a miniature omnidirectional switch instantly responsive to an impact of sufficient magnitude to open normally closed contacts in the switch.

2. Description of the Art

A typical miniature acceleration switch of a type described in prior U.S. Pat. Nos. 4,746,774, and 4,789,762 has a cylindrical shell or housing closed by a header at one end. In the shell is a cylindrical mass movable axially or tiltable laterally against spring bias in response to forces of acceleration applied to the housing and mass. The displaced electrically conductive mass closes a normally open electric circuit between spaced electrically conductive terminals.

The prior miniature acceleration switches have been found to respond too slowly to an applied impact in applications where the switch must respond to an impact in less than 200 microseconds. In the prior switches the electrical contacts are normally open and are spaced apart sufficiently so that externally applied random vibrations do not cause the switch contacts to close. The time required for the mass to move to close the open contacts upon application of an actuating force is several milliseconds or longer. The switch cannot respond fast enough where the response time must be 0.2 of a millisecond or less. Another disadvantage of the prior switches is that they are normally open and are not useable in applications where the switch contacts must be normally closed. Some of the prior switches are limited to respond to forces directed only axially of the housings in which the masses move. Other switches are limited to respond only to forces directed laterally or angularly to the axes of the housings.

SUMMARY OF THE INVENTION

The present invention is directed at overcoming the disadvantages specified above and other difficulties and disadvantages of the miniature acceleration switches heretofore known. A principal object of the invention is to provide an instantly acting miniature acceleration switch which will respond to an axial, lateral, or angular impact of sufficient magnitude in less than 200 microseconds to open contacts in the switch for 50 microseconds or more. This open time is sufficient to actuate an associated external circuit. No known prior acceleration switch is sufficiently sensitive to meet these omnidirectional instant response requirements.

According to the invention there is provided a miniature omnidirectional instant acting impact switch assembly having a cylindrical shell or housing in which is a generally cylindrical mass movable axially and tiltable angularly in response to a force of impact applied in any direction, with respect to the axis of the housing, to open the switch contacts. The range of movement of the mass is very small, being limited to not more than 0.001 of an inch, which distance the mass can instantly traverse in less than 200 microseconds. The mass normally bridges two spaced contacts electrically. A coil spring in the housing holds the mass in a fixed position with such static force that it requires 25 an impact of 500 G or more where G is a unit of acceleration applied in any direction to the switch housing to open the switch contacts. The inertia of the mass is such that the switch contacts will respond to the impact to open the switch contacts in less than 200 microseconds and will keep the switch contacts open for 50 microseconds or more, to allow the external circuitry time to recognize the open condition of the switch and to react accordingly.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
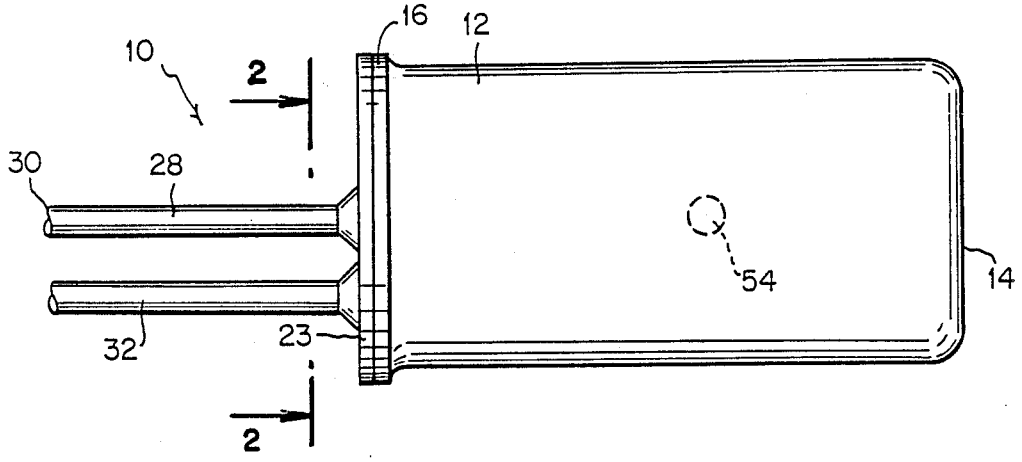
FIG. 1 is a side elevational view of a miniature impact switch embodying the invention, the switch being shown on a greatly magnified scale.
Figure 2:
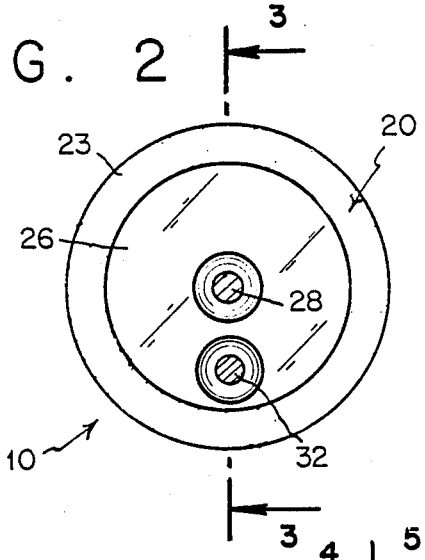
FIG. 2 is a cross sectional view taken along line 2—2 of FIG. 1.
Figure 4:
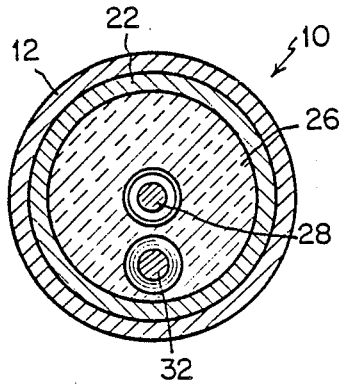
FIG. 4 and FIG. 5 are cross sectional views taken along lines 4—4 and 5—5 respectively of FIG. 3.
Figure 3:
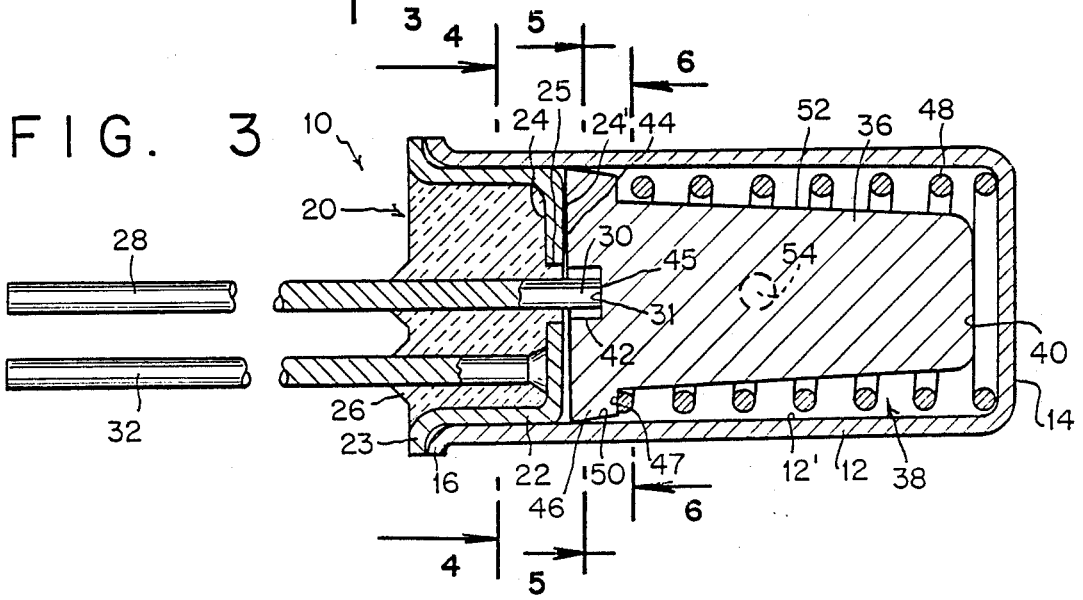
FIG. 3 is a diametral axial sectional view taken along line 3—3 of FIG. 2.
Figure 5:
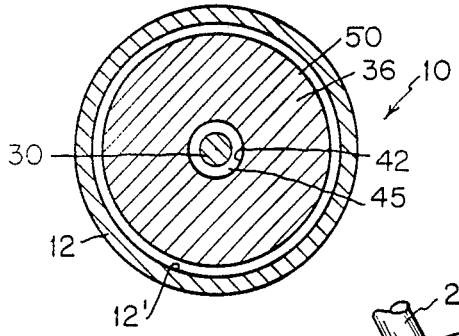

Referring now to the drawings wherein like reference characters designate like or corresponding parts throughout, there is illustrated in FIGS. 1-6, a miniature impact switch generally designated by reference numeral 10, embodying the invention. The new switch 10 has an electrically conductive cylindrical housing or shell 12 made of a metal such as nickel. The shell is closed at one end by a circular wall 14 and is open at the other end with an outwardly turned annular radial flange 16. Fitted into the open end of the housing 12 is a header 20 having an electrically conductive cylindrical skirt 22 terminating in a flat circular end wall 24 having a central aperture 25. The header 20 terminates at its outer end in a radial flange 23 abutting the annular flange 16 and welded thereto to secure and seal the header 20 permanently to the housing or shell 12. The header 20 contains an insulative plug or filling 26 made of glass, ceramic, plastic, or other suitable insulative material. Extending axially through the center of the cylindrical plug 26 and bonded thereto is an electrically conductive lead wire 28 and terminating at an end 30 with an end surface 31. The wire 32 is bonded to the inner side of the end wall 24 in direct electrical contact therewith.

Disposed in the housing 12 is a cylindrical mass 36 made of a suitable metal such as brass which is highly conductive electrically. The mass 36 extends axially almost the full length of the interior cavity 38 in the housing 12. A flat end wall 40 of the mass 36 is normally spaced from the end wall 14 a short distance exceeding the maximum distance the mass 36 can travel axially upon longitudinal impact applied the switch 10. The mass 36 has a short central axial bore 42 with an end wall 45 at a mass end 44. The bore 42 is larger in diameter than that of the wire end 30. In actual practice the wire end 30 is about 0.020 inches in diameter.

The mass 36 has a radial annular flange 46 at the end 44 which is held in contact with the outer side 24' of the end wall 24 at all times by an axially compressed coil spring 48 seated on a shoulder 47 of the flange 46 at one end, and the other end of the spring 48 bears against the end wall 14 of the housing 12. The flange 46 has a sharp circular rim 36' around the end wall 44. A side wall 50 of the flange 46 is slightly tapered or frustoconical in shape for reasons explained below. In addition a side wall 52 of the conical mass 36 is tapered slightly from its wider end at the shoulder 47 of the flange 46 to narrower end wall 40. The widest diameter of the side wall 52 at the flange 46 is substantially equal to the internal diameter of coil spring 48. At the end wall 40 of the mass 36 the inside diameter of the spring 48 is larger than the diameter of the end wall 40 to permit the mass 36 to tilt angularly with respect to the axis of the housing 12 when an angular or lateral impact is imparted to the housing. The center of gravity 54 of the mass 36 is located on the longitudinal axis of the mass 36 and at a point between the shoulder 47 and the end wall 40.

Figure 6:
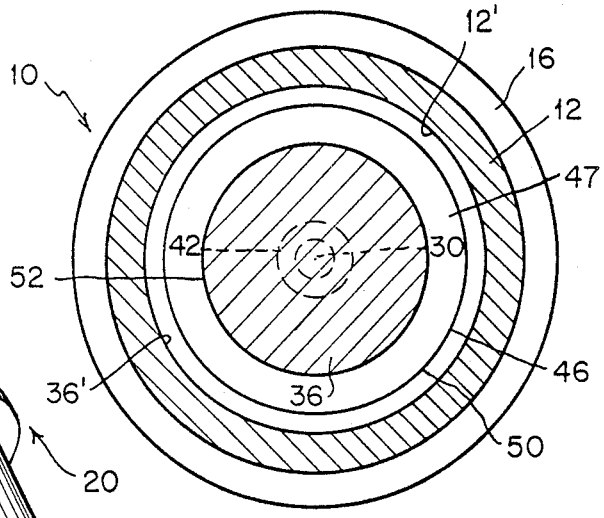
FIG. 6 is a cross sectional view on an enlarged scale taken along line 6—6 of FIG. 3 (the spring 48 has been omitted for purposes of clarity)
Figure 6:
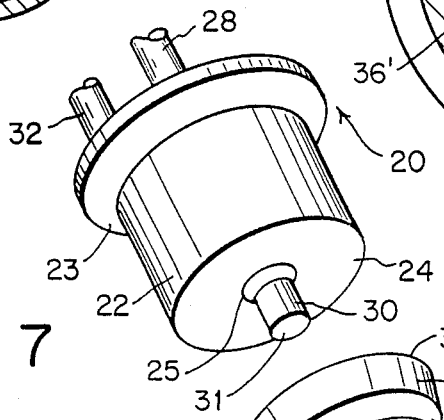
Figure 7:
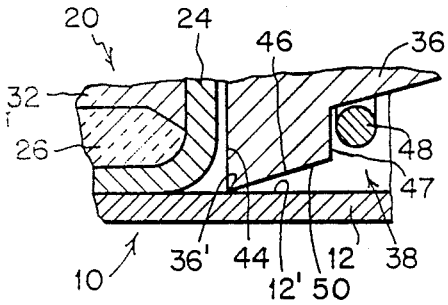
FIG. 7 is a further enlarged view of a portion of FIG. 3.
Figure 7:
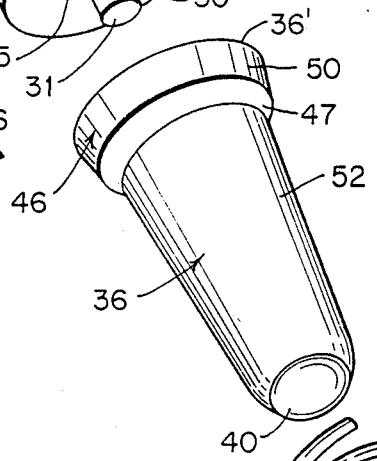
Figure 8:
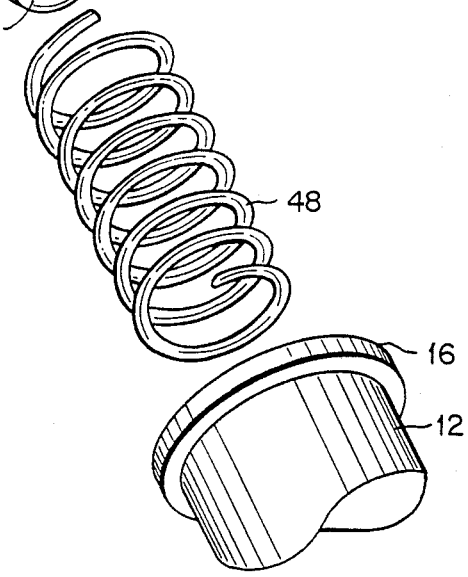
FIG. 8 is an exploded perspective view of parts of the impact switch assembly.
Figure 9:
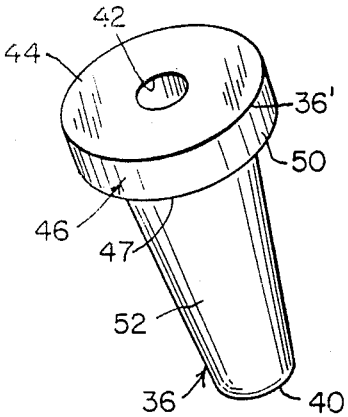
FIG. 9 is a perspective view of the movable mass of the assembly of FIG. 8 taken in an inverted position.

The length of the wire end portion 30 is about 0.001 of an inch longer than the axial length of the bore 42 so that the mass 36 is very slightly tilted at an angle to the axis of the housing 12. The coil spring 48 tilts and holds the mass 36 in this tilted position with one of portion of rim 36' of the flange 46 in firm contact with the outer end wall 24' of the header; see FIG. 3. The rim 36' is about 0.001 of an inch smaller in diameter than the diameter of the housing 12 at an internal wall 12'. This allows about 0.0005 of an inch clearance between the rim 36' and the wall 12' to permit the mass 36 to tilt about 0.001 of an inch to separate the bore wall 45 from the wire end 31 to open the switch contacts. At all times, in the absence of an applied force of impact, the lead wires 28 and 32 are in direct electrical contact or closed circuit via the mass 36. The electrical contact between the mass 36 and the header wall 24 is less than 500 ohms. When an impact force is applied laterally, longitudinally or angularly, it is only necessary for the mass 36 to move from 0.0005 to 0.001 of an inch to open the circuit between the wires 28 and 32 as the inner wall 45 of the bore 42 moves away from the end 30 of the wire 28. When a longitudinal impact is applied to the housing end wall 14 the mass 36 moves axially against the spring bias. When a lateral or angular impact is applied to the mass 36 it tilts angularly at a point on the diameter of the rim 36' without binding or jamming at the housing 12 or at the spring 48. In order to facilitate tilting movement of the mass 36, the largest diameter of the mass at the rim 36' of the mass wall 44 is substantially equal to the internal diameter of the housing wall 12'. From there, the flange wall 50 tapers inwardly radially as best shown in FIGS. 6 and 7. This construction permits the mass to tilt rather than rotate when an angular impact is applied to the housing 12.

The impact switch 10 is constructed to respond within 200 microseconds when an external impact in excess of about 500 G is applied in any direction to the housing 12 which would open the switch contacts. The spring 48 applies sufficient circuit closure pressure or bias to the mass 36 so that it is held in tilted position and cannot be displaced by operational or random vibrations which normally do not exceed 20 G. For operational stability the space or chamber 38 in the housing 12 can be evacuated of air and filled with an inert gas such as helium, argon, etc., after which the housing is hermetically sealed and closed by welding the header 20 to the shell 12. To insure long shelf life, the housing 12 can be made of noncorrosive metal such as nickel. The mass can be made of brass plated with gold or other noncorroding metal. The conductors 28 and 32 are typically made of a nickel alloy such as Kovar®. The mass 36 and the header 20 are typically gold or silver plated for electrical conductivity.

The overall length of the housing 12 will not be more than about one half inch and the diameter of the cylindrical body of the housing 12 will not be more than about a quarter of an inch. The leads 28 and 32 may be about one half an inch in length. The total weight of the switch 10 will be about one gram. Thus the impact switch assembly is truly miniature in size. It can be used in applications requiring response to an impact of sufficient magnitude such as 500 G or more, in less than 200 microseconds and the inertia of the mass 36 will be such as to keep the switch 10 open circuited for at least 50 microseconds. Prior acceleration switches cannot respond in such an extremely short time with omnidirectional sensitivity. The impact sensed by the switch assembly 10 can be a grazing impact of an object lasting only a few microseconds. Nevertheless, if the impact exceeds the 500 G threshold or bias, the switch 10 will respond within 200 microseconds to open circuit the wires or leads 28, and 32, as the mass 36 separates by as little as 0.001 of an inch from the outer end wall 24' and the wire end 31. The conductor lead wires 28 and 32 are close circuited by the spring bias on the mass 36. The mass is normally held in axially tilted position by the spring bias and because the conductor end 31 is axially longer than the axial length of the blind bore 42 in the end of the mass 36 by about 0.001 of 10 an inch. Since the mass 36 is held tilted only a small portion of the end 44 of the mass 36 contacts the header wall 24, so only a small movement of the mass 36 is sufficient to open circuit the closed circuit members.

It should be understood that the foregoing relates to only a preferred embodiment of the invention which has been by way of example only, and that it is intended to cover all changes and modifications of the examples of the invention herein chosen for the purpose of the disclosure, which do not constitute departures from the spirit and scope of the invention.

What is claimed is:

1. A miniature omnidirectional instantly responsive impact switch, comprising:

a hollow cylindrical housing closed at one end and open at the other end to define a cylindrical chamber therein;

a cylindrical header secured in and closing said open end of said housing, said header having an electrically conductive header wall with a central aperture facing inwardly of said chamber, and an insulator adjacent said header wall and facing outwardly of said housing;

a first electrical conductor extending axially through said insulator and having a free end extending through said aperture in said header wall;

a second electrical conductor extending axially through said insulator and spaced from said first conductor and connected to said header wall;

an electrically conductive mass having a generally cylindrical body movably disposed in said chamber, said body having an end with a blind bore therein, said bore having an internal end wall, said bore receiving said free end of said first conductor in contact with said internal end wall to tilt said mass axially in said housing; and a compressed coil spring in said chamber biasing said tilted mass so that a portion of said end thereof contacts said header wall, whereby said first and second conductors are connected electrically in a closed circuit via said mass and said header wall;

whereby said mass separates instantly from said first conductor against the bias of said spring when an impact of sufficient magnitude is applied to said housing to open said closed circuit momentarily.

2. An impact switch as claimed in claim 1, wherein said bore in said mass has an axial length slightly less than the length of said free end of said first conductor so that said mass tilts axially in said chamber under applied bias of said spring.

3. An impact switch as claimed in claim 2, wherein said mass has a radially extending flange at said end thereof, said flange having a shoulder providing an abutment for one end of said spring while the other end of said spring bears against said closed end of said housing.

4. An impact switch s claimed in claim 3, wherein said flange and said body of said mass are axially tapered to facilitate tilting of said mass in response to said impact on said housing.

5. An impact as claimed in claim 4, wherein said flange has a sharp rim at said end of said mass whose diameter is only slightly smaller than the diameter of said chamber to facilitate tilting of said flange and said body of said mass in response to said impact on said housing.

6. An impact switch as claimed in claim 5, wherein said mass is movable axially against the bias in said spring to open said closed circuit in response to an impact applied to said closed end of said housing.

7. An impact switch as claimed in claim 4, wherein said internal end wall of said bore is flat, and wherein said free end of said first conductor has a flat end portion contacting said flat end or said bore so that a movement of said mass separating said flat end wall of said bore and said flat end portion of said first conductor by approximately 0.001 of an inch is sufficient to open said closed circuit.

8. An impact switch as claimed in claim 7, wherein said header is cup shaped with a cylindrical skirt secured and sealed to said open end of said housing, to secure said insulator and said header wall in fixed positions in said housing.

9. An impact switch as claimed in claim 8, wherein said housing has an overall length of about one half of an inch and a diameter of about a quarter of an inch, so that said switch is miniature in size; and wherein said mass has a maximum diameter at said rim of said flange which is about 0.001 of an inch less than said diameter of said chamber, so that said mass moves to open said closed circuit within 200 microseconds after said impact is applied to said housing.

10. An impact switch as claimed in claim 9, wherein said mass has sufficient inertia to keep said circuit open for at least 50 microseconds after said closed circuit is opened.

* * * * *